US005103259A

United States Patent [19]

Saitoh et al.

[11] Patent Number: 5,103,259

[45] Date of Patent: Apr. 7, 1992

[54] IMAGE FORMING APPARATUS HAVING A SENSOR FOR CHECKING MOUNTED UNITS

[75] Inventors: Takashi Saitoh, Tokyo; Yasufumi Tanimoto, Fujisawa, both of Japan

[73] Assignee: Kabushiki Kaisha Toshiba, Kawasaki, Japan

[21] Appl. No.: 603,452

[22] Filed: Oct. 26, 1990

[30] Foreign Application Priority Data

Oct. 31, 1989 [JP] Japan ..... 1-283750

[51] Int. Cl.[5] ..... G03G 15/00

[52] U.S. Cl. ..... 355/206; 340/679

[58] Field of Search ..... 355/20, 203, 204, 206, 355/211; 340/648, 664, 679; 318/432–434; 364/550; 324/158 MG

[56] References Cited

FOREIGN PATENT DOCUMENTS 61-52662 3/1986 Japan ..... 355/206

*Primary Examiner*—Joan H. Pendegrass

*Attorney, Agent, or Firm*—Foley & Lardner

[57] ABSTRACT

An image forming apparatus in which parts of an image forming portion are formed as modular units, including, a section for driving the image forming portion, a section for detecting a signal representing a torque of the driving section, and a section for discriminating the attachment or detachment of the modular parts of the image forming portion according to the signal representing the torque detected by the detecting section. The load on the driving section, which is changed by the attachment of the modular parts of the image forming portion, is measured, and the attachment of a plurality of units can be checked by means of one attachment-/detachment sensor without using many sensors for respective parts or units.

9 Claims, 10 Drawing Sheets

IMAGE FORMING APPARATUS HAVING A SENSOR FOR CHECKING MOUNTED UNITS

BACKGROUND OF THE INVENTION

1. Field of the Invention

The present inventor relates to an image forming apparatus mounted with modular parts of image forming means, such as an electrophotographic process unit, and applicable to a laser printer and the like.

2. Description of the Related Art

In modern image forming apparatuses, such as electronic copying machines and printers, parts of image forming means are modular units, including a developing unit, fixing unit, etc. These units can be individually removably mounted in the apparatus body.

If each unit is not mounted, that is, if it not connected electrically or mechanically to the apparatus body, the image forming apparatuses of this type cannot perform normal image forming operations. Accordingly, a sensor is provided for each unit, whereby the attachment of the unit can be detected.

If each unit is furnished with such a sensor, however, the manufacturing costs increase correspondingly, and mounting the sensors require much labor.

In the conventional image forming apparatuses, as described above, a sensor must be provided for each unit to detect the attachment of the unit, so that the apparatus is more expensive as a whole, and more processes are required to assemble the apparatus.

SUMMARY OF THE INVENTION

Accordingly, the object of the present invention is to provide an image forming apparatus capable of checking a plurality of mounted units by means of a single sensor, thus permitting reduction in cost and in the number of assembling processes.

In order to achieve the above object, an image forming apparatus according to the present invention, in which parts of image forming means are formed as modular units, comprises: a drive section for driving the image forming means; a detecting section for detecting a signal corresponding to tle torque of the drive section; and a discriminating section for discriminating the attachment or detachment of the modular parts of the image forming means by the signal corresponding to the torque detected by the detecting section.

According to the present invention the load on the drive section, which may be changed by the attachment of the modular parts of the image forming means, is measured, so that the attachment of a plurality of units can be checked by means of one attachment/detachment sensor without providing a sensor for each part or unit.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be described with reference to the accompanying drawings.

Figure 1:
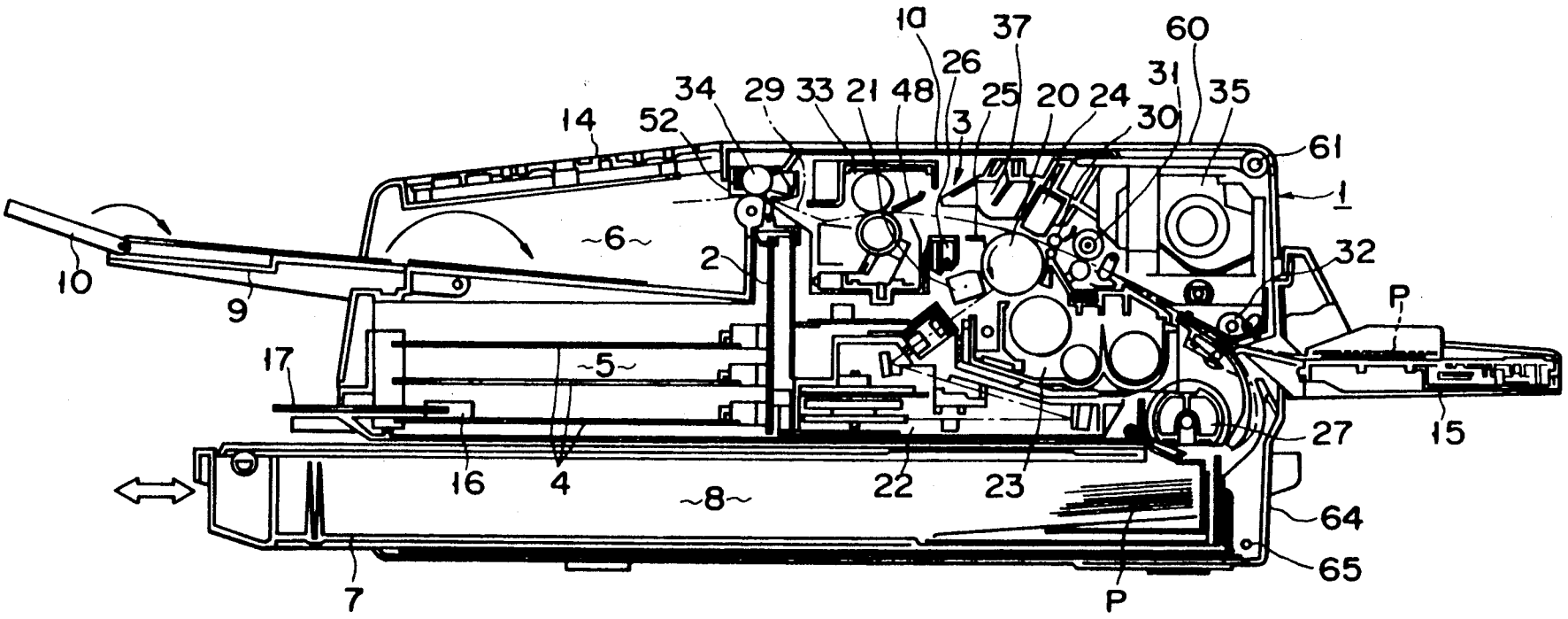
FIG. 1 is a side sectional view showing the internal construction of a laser printer.

FIG. 1 shows an image forming apparatus, e.g., a laser printer, according to the present invention.

The laser printer is connected to a host apparatus as an external output apparatus (e.g., electronic computer, word processor, etc.) through a transmission controller such as an interface circuit. On receiving a print start signal from the host apparatus, the laser printer starts its image forming operation, and outputs an image by recording it on a paper sheet as a transfer medium.

In FIG. 1, numeral 1 denotes a printer body, which has an open section at the top. A main control board (engine control board) 2 is disposed in the central portion of the body 1. An electrophotographic process unit 3 for image forming operation is located behind or to the right of board 2. A control board holding section 5, for holding a plurality of control boards (printer control board) 4 for additional functions, is disposed at the lower part of the front portion of the printer body 1. Further, a paper delivery section 6 is formed at the upper part of the front portion of the body 1. It is used to deliver the paper sheet with the recorded image thereon.

The control boards 4 for additional functions may be mounted to the maximum number of three, depending on the additional functions (e.g., extension fonts, additional Chinese characters, etc.).

A plurality of IC card connectors 16 (e.g., three in number) are arranged at the front edge portion of the control board 4 for additional functions, which is situated at the lowest stage of the control board holding section 5. Optional functions can be added to the system by inserting IC cards 17 into any of the connectors 16.

The IC cards 17 are composed of a nonvolatile memory (NVM), such as a static RAM with a battery backup circuit, $E^2$PROM, EPROM, or mask ROM. These IC cards are stored with fonts, emulation program, etc., for example.

Meanwhile, two interfaces (not shown) are arranged at the left-hand end portion of that control board 4 which is situated at the lowest stage of the control board holding section 5. These interfaces are opposed to an opening section 18 of the printer body 1.

The lower part of the printer body 1 constitutes a cassette holding section 8 for holding a paper cassette 7 which can contain a large number of paper sheets P. The paper cassette 7 is adapted to be inserted into the cassette holding section 8 through the lower part of its front face. The arrow of FIG. 2 indicates the cassette loading direction.

The paper delivery section 6 is formed of a cavity recessed from the front top portion of the printer body 1. Attached to the front edge portion of the section 6 is a swingable receiving tray 9 which can be folded back on the section 6 or stretched as illustrated.

A substantially U-shaped notch 9*a* is formed in the central portion of the front end of the tray 9. The notch 9*a* is provided with an auxiliary receiving tray 10 which can be stretched or retracted. Thus, the size of the receiving tray 9 can be adjusted depending on the size of the paper sheets to be delivered.

An operation panel 14 is provided on the top surface of a left-hand frame portion 1*b* of the printer body 1 which is situated on the left of the paper delivery section 6. A sheet-bypass tray 15 for manual paper feed is attached to the rear side of the body 1.

The following is a description of various processes of image forming operation or electrophotographic processes, including charging, image exposure, developing, transfer, separation, cleaning, and fixing.

A drum-shaped photoreceptor 20 for use as an image carrying body is located substantially in the center of a unit holding section. The photoreceptor 20 is surrounded by a charging unit 21 formed of a scorotron, a laser exposure unit 22 for forming an electrostatic latent image at an exposure section 22*a*, and a developing unit 23 of a magnetic-brush type capable of simultaneously executing a developing process and a cleaning process. The photoreceptor 20 is further surrounded by transfer unit 24 formed of a scorotron, memory removing unit 25 formed of a brush member, and pre-exposure unit 26. These elements are arranged successively in the order named along the rotating direction of the photoreceptor 20. Among these elements, the photoreceptor 20, charging unit 21, developing unit 23, and memory removing unit 25 are integrated into the electrophotographic process unit 3, which is removably set in the printer body 1.

The developing unit 23 uses two-component developing agent D formed of a toner t and a carrier c.

A paper transportation path 29 is formed in the printer body 1. It guides paper sheets P, automatically fed from the paper cassette 7 by paper feed unit 27 or manually fed from the sheet-bypass tray 15, into the paper delivery section 6 through an image transfer section 28 between the photoreceptor 20 and the transfer unit 24.

A feed roller pair 30, an aligning roller pair 31, and a feed roller pair 32 are arranged on the uppercourse side of the paper transportation path 29 with respect to the image transfer section 28. A fixing unit 33 and an exit roller unit 34 are arranged on the lower-course side of the path 29.

A cooling fan unit 35 is disposed over the location of the feed roller pair 32, an aligning switch 36 is located in the vicinity of the aligning roller pair 31, and a transportation guide 37 is disposed over the image transfer section 28.

Numeral 320 denotes a paper-empty switch which, located near the paper feed unit 27, serves to detect the presence of the paper sheets P in the paper cassette 7. Numerals 321 and 322 denotes a manual feed switch and a paper delivery switch located near the feed roller pair 32 and the exit roller unit 34, respectively.

At the start of the image forming operation, the photoreceptor 20 is rotated when the laser printer receives the print start signal from the host apparatus. The surface potential of the photoreceptor 20 is kept constant by the pre-exposure unit 26, and the photoreceptor surface is uniformly charged by the charging unit 21.

In this state, a laser team a, modulated in response to dot image data from the host apparatus, is emitted from the laser exposure unit 22 to be applied to the photoreceptor 20. An electrostatic latent image corresponding to a video signal is formed on the surface of the photoreceptor 20 by scanning and exposing the surface by means of the laser beam a. The latent image on the photoreceptor 20 is developed into a visible image (toner image) by means of the toner t in a developing-agent magnetic brush D* of the developing unit 23.

In synchronism with the toner image forming operation, one of the paper sheets P, taken out from the paper cassette 7 or manually fed from the sheet-bypass tray 15, is delivered into the image transfer section 28 through the aligning roller pair 31. Thereupon, the toner image previously formed on the photoreceptor 20 is transferred to the sheet P by the agency of the transfer unit 24.

Subsequently, the paper sheet P, having the transferred toner image thereon, is guided by the transportation guide 37 to be fed into the fixing unit 33 through the paper transportation path 29. In the fixing unit 33, the toner image is melted and fixed to the sheet P. Thereafter, the paper sheet P is delivered to the paper delivery section 6 via the exit roller unit 34.

After the toner image is transferred to the paper sheet P, residual toner particles t on the surface of the photoreceptor 20 is removed by electrostatic attraction by means of the memory removing unit 25 which is formed of an electrically conductive brush. As a result, the toner distribution on the photoreceptor surface becomes uniform, and the toner t is absorbed mechanically and electrostatically by the developing unit 23.

The following is a description of the arrangement of a control system of the laser printer.

Figure 2A:
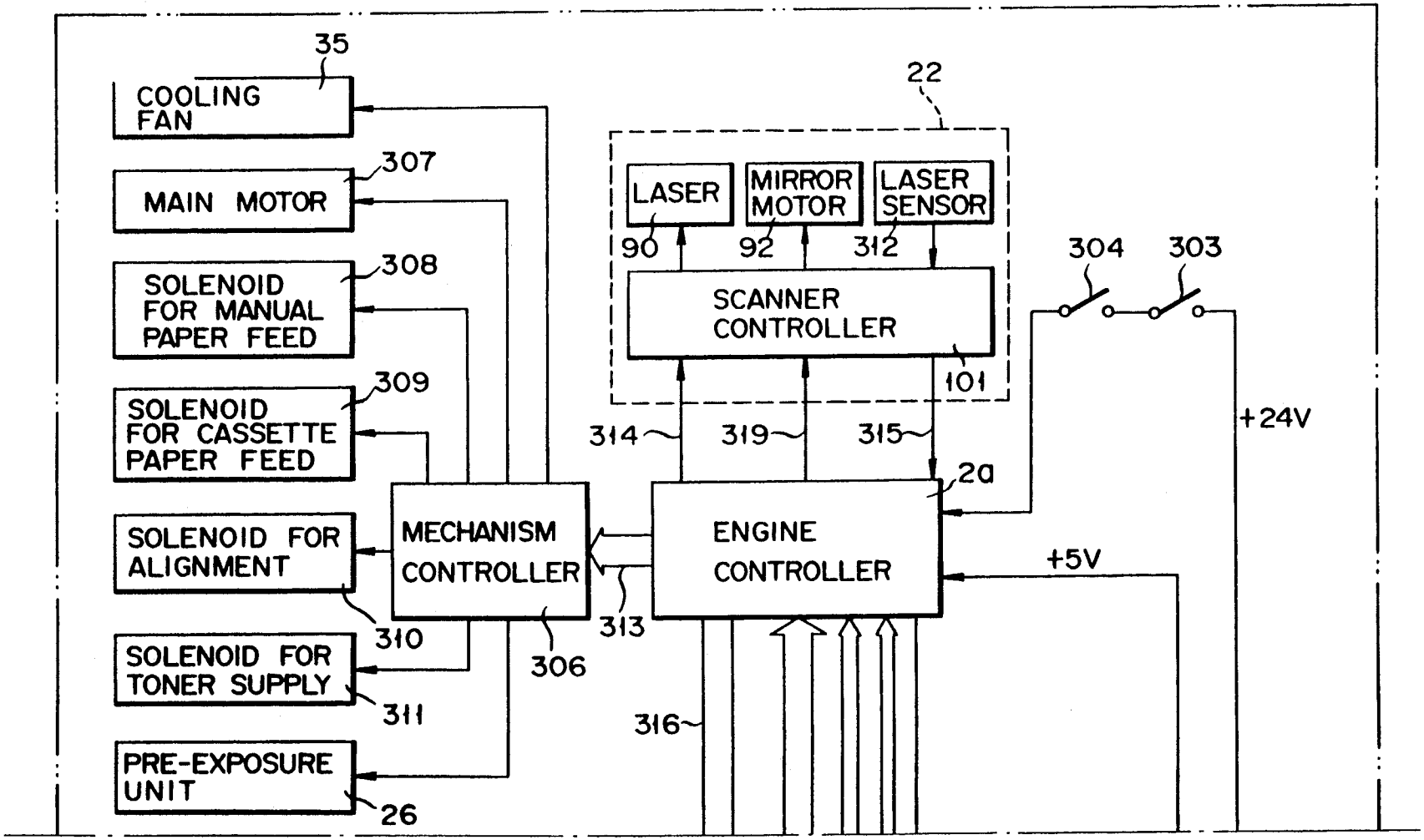
FIGS. 2A-2C are block diagrams schematically showing the principal part of a control system in the laser printer of FIG. 1.
Figure 2B:
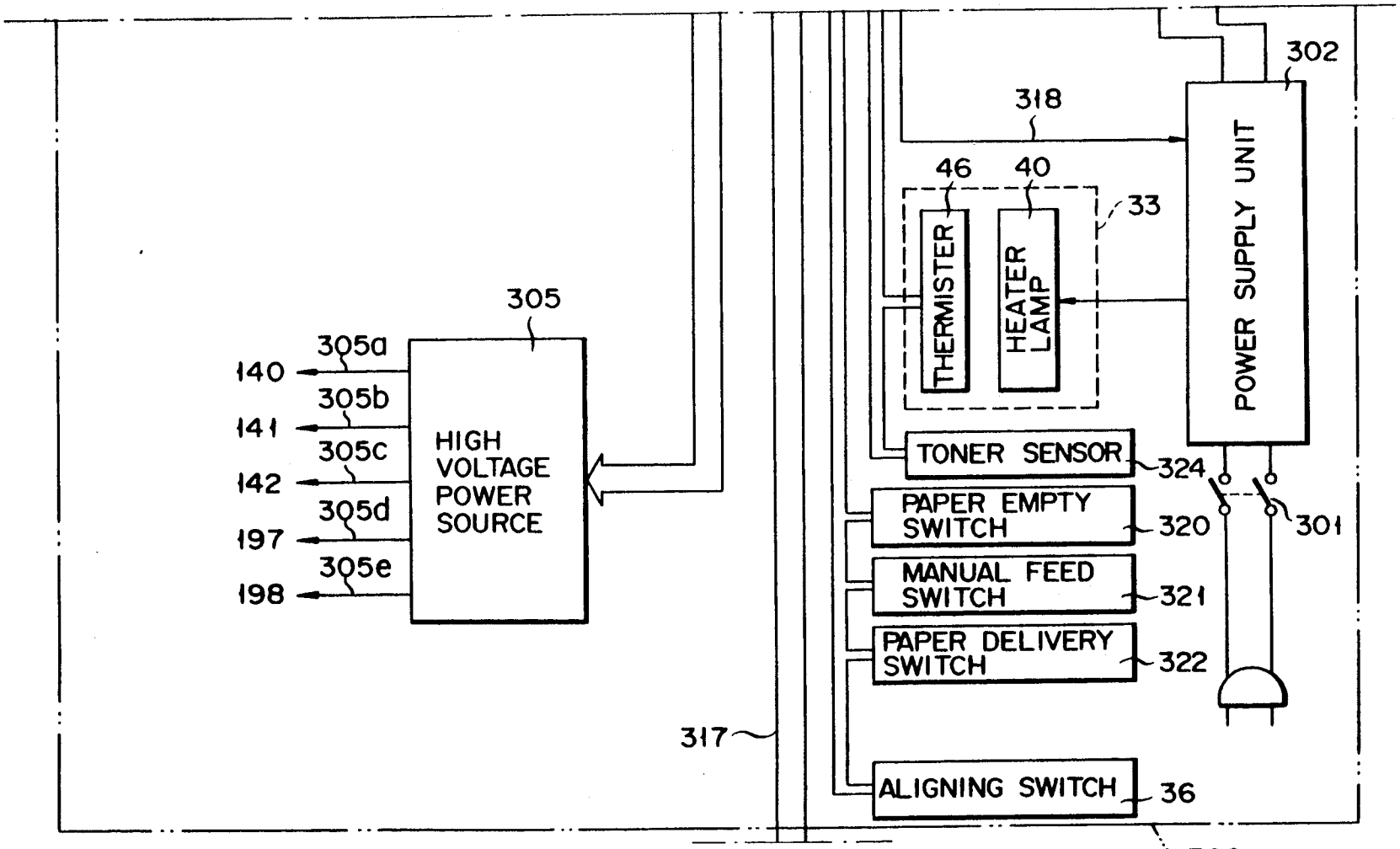
Figure 2C:
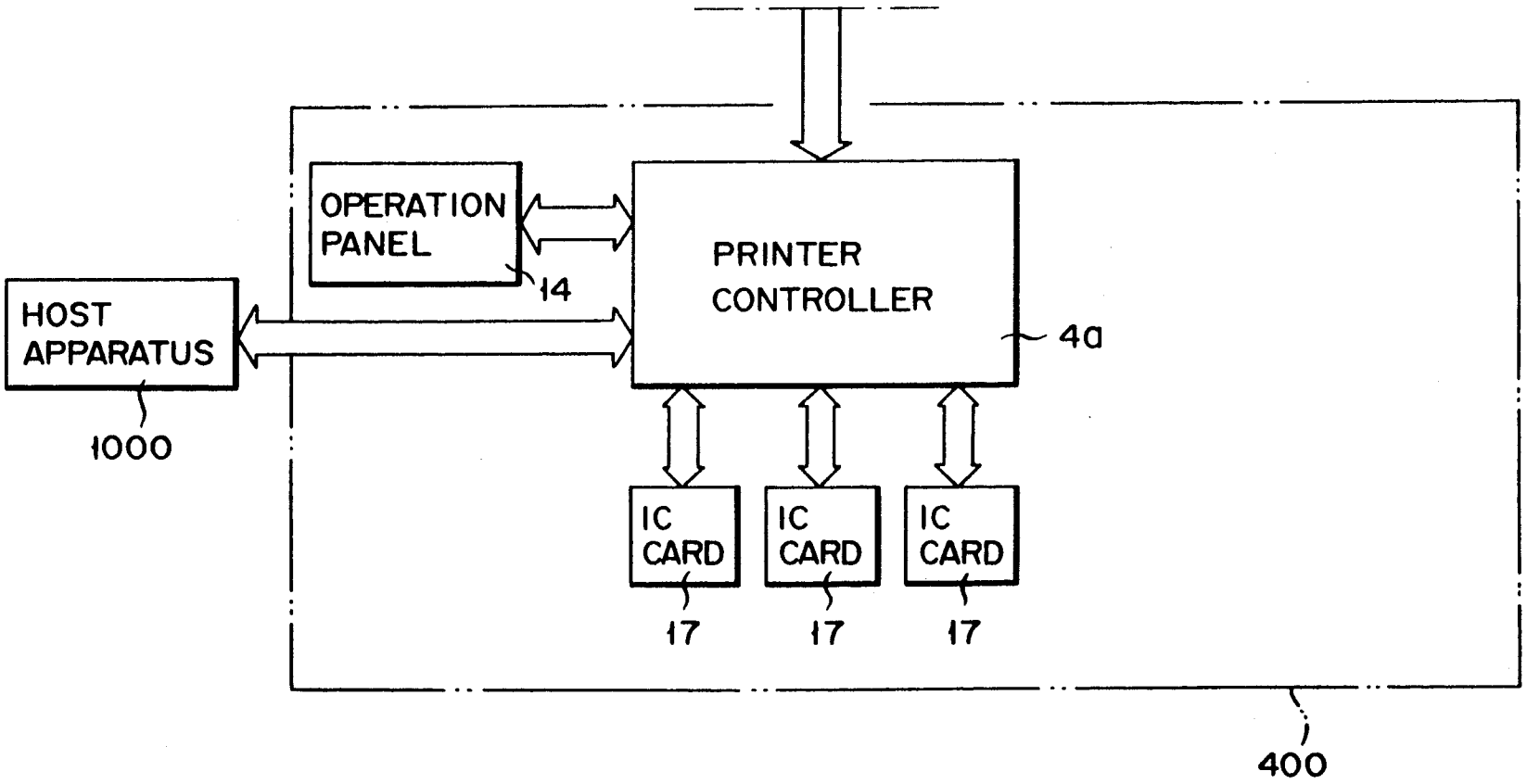

FIGS. 2A–2C show the principal part of an engine control section 300 for controlling the individual elements in the printer body 1, thereby accomplishing the electrophotographic processes.

In FIG. 2B, numeral 302 denotes a power supply unit. When a main switch 301 of the printer body 1 is turned on, voltages of +5 V and +24 V are delivered from the power supply unit 302. The supply voltage of +5 V is supplied to an engine controller 2*a* in FIG. 2A, and further to a printer controller 4*a* of a printer control section 400 in FIG. 2C, which is connected to the controller 2*a*.

On the other hand, the supply voltage of +24 V is supplied to the engine controller 2*a* successively through cover switches 303 and 304. Further, it is supplied from the controller 2*a* to a scanner controller 101 in the laser exposure unit 22, a high-voltage power source 305, and a mechanism controller 306. Thus, the power supply unit 302 serves as a power source for driving a semiconductor laser 90 and a mirror motor 92 in the exposure unit 22, &he high-voltage power source 305, the pre-exposure unit 26, a main motor 307, a solenoid 309 for cassette paper feed, a solenoid 308 for manual paper feed, a solenoid 310 for alignment, a solenoid 311 for toner supply, the cooling fan unit 35, etc.

The power supply unit 302 contains a heater lamp driver (not shown) of the zero-cross switch type which, formed of, for example, a photo-triac coupler and a triac, serves to drive the heater amp 40 of the fixing unit 33. The aforesaid supply voltage of +24 V is used as a power source for driving an LED on the light emitting side of the photo-triac coupler. In a heater lamp driver constructed in this manner, as is generally known, when the LED on the light emitting side is turned on or off, the photo-triac on the light receiving side is turned on or off at the zero-cross point of the ac power source. As the triac, for use as a main switch element for the next stage, is turned on or off by this on-off operation, the heater lamp 40 is connected to or disconnected from the ac power source. A heater control signal 318 for turning on or off the LED on the light emitting side is supplied from the engine controller *2a* to the power supply unit 302, and the thermistor 46 in the fixing unit 33 is connected to the controller *2a*.

The cover switch 303 is turned off when the top cover 60 is rocked upward, and the cover switch 304 is turned off when the rear cover 64 is swung open. Thus, when the top or rear cover 60 or 64 is off, the switch 303 or 304 serves to cut off the supply of the supply voltage of +24 V to the engine controller *2a*. As a result, the laser exposure unit 22, high-voltage power source 305, and mechanism controller 306 are cut off from the power supply, so that the various elements are caused to be nonoperating. In this state, the operator is allowed to touch the mechanisms in the printer body 1 without any trouble.

Figure 3:
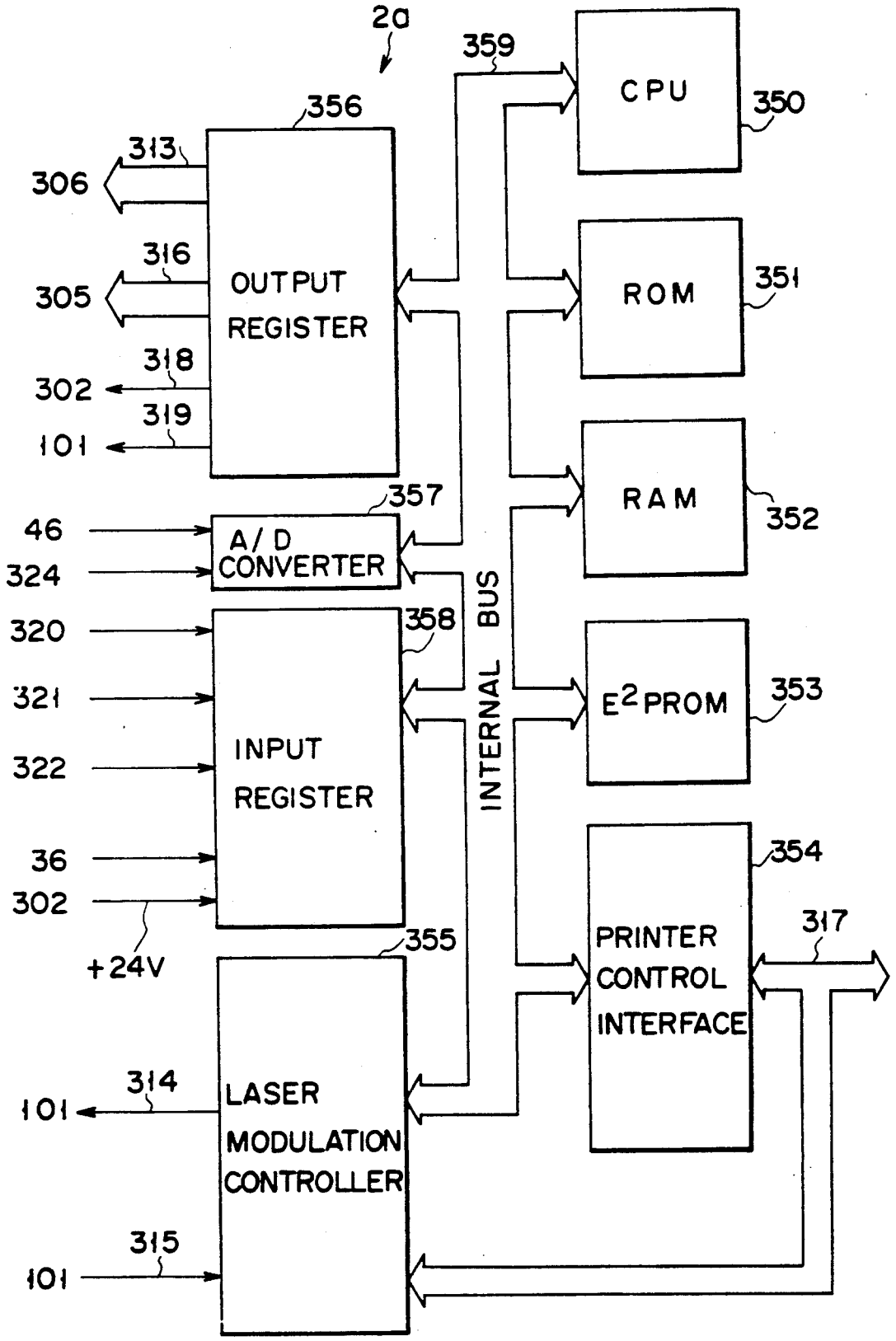
FIG. 3 is a block diagram showing a configuration of an engine controller shown in FIG. 2A.

FIG. 3 shows a configuration of the engine controller *2a*.

In FIG. 3, a CPU 350, which is used to control the whole circuit, operates in accordance with a control program stored in a ROM 351.

A RAM 352 serves as a working buffer for the CPU 350.

An $E^2$PROM 353 is adapted to store the total number of prints, the number of prints made by means of the electrophotographic process unit 3 currently set in the printer, and a decision value for the detection of each mounted unit.

A printer control interface 354 delivers an interface signal 317 to or from the printer controller *4a*.

A laser modulation controller 355 periodically forces the semiconductor laser 90 to grow in order to produce a laser detection signal 315, which will be mentioned later. Also, the controller 355 modulates the laser 90 in accordance with image data transmitted from the printer controller *4a* by means of the interface signal 317. Thus, a laser modulation signal 314 is delivered to the scanner controller 101.

An output register 356 delivers control signals 313, 316, 318 and 319 for controlling the mechanism controller 306, scanner controller 101, high-voltage power source 305, and the heater lamp driver, respectively.

An A/D converter 357 receives a voltage produced in the thermistor 46 or a toner sensor 324 and a signal obtained by converting a current corresponding to the load fluctuation of the main motor 307 into a voltage, and converts the voltage value into a digital value.

An input register 358 receives state signals from the paper-empty switch 320, manual feed switch 321, paper delivery switch 322, and aligning switch 36 and a signal indicative of the on-off state of the supply voltage of +24 V.

An internal bus 359 serves to deliver data between the CPU 350, ROM 351, RAM 352, $E^2$PROM 353, printer control interface 354, laser modulation controller 355, output register 356, A/D converter 357, and input register 358.

The mechanism controller 306 in FIG. 2A, which is provided with drivers for driving the motor, solenoids, and other elements, is turned on or off in response to the value "1" or "0" for the control signal 313 delivered from the output register 356. More specifically, the individual drivers are turned on when the control signal is "1," and are turned off when the control signal is "0," so that the pre-exposure unit 26, main motor 307, solenoids 308 to 311, and cooling fan unit 35 are connected to or disconnected from the supply voltage of +24 V.

The scanner controller 101 is provided with drivers for the semiconductor laser 90 and the mirror motor 92. The laser 90 is turned on or off in response to the value "1" or "0" for the laser modulation signal 314 delivered from the laser modulation controller 355, while the motor 92 is turned on or off in response to the value "1" or "0" for the control signal 319 delivered from the output register 356.

Further, a PIN diode is used as a laser sensor 312. When the laser beam a passes through the sensor 312, a current flows in proportion to its optical energy. In the scanner controller 101, therefore, the current from the sensor 312 is converted into a voltage, which is then amplified and delivered as the laser detection signal 315 to the laser modulation controller 355.

High voltages 305*a*, 305*b*, 305*c*, 305*d* and 305*e* for developing bias, memory removal, charging, transfer grid, and transfer are delivered to a developing bias supply section 140, a power supply section 141 for the memory removing unit 25, a power supply section 142 for the charging unit 21, a grid voltage supply section 197 for the transfer unit 24, and a wire high-voltage supply section 198, respectively. These power supply sections are turned on or off in response to the value "1" or "0" for the control signal 316 delivered from the output register 356.

In the engine control section 300, as described above, electric power is supplied to the individual electric circuits through the engine controller *2a*, and the circuits are controlled in response to the binary signals delivered from the controller *2a*. The engine control section 300 (FIG. 2A and 2B) and the printer control section 400 (FIG. 2C) are connected by means of the interface signal 317.

Figure 4:
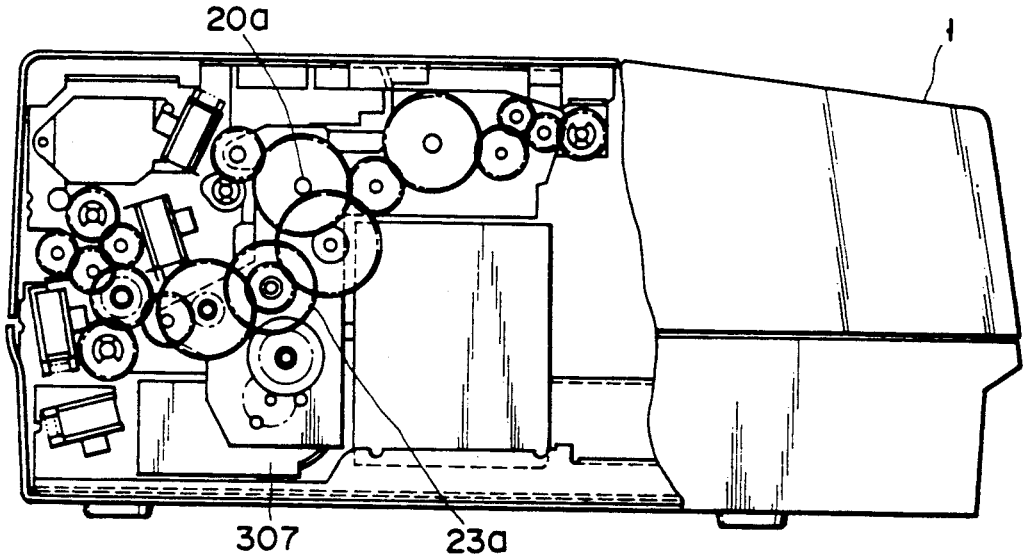
FIG. 4 is a schematic view, partially in section, showing a drive system in the laser printer of FIG. 1.

FIG. 4 shows a drive system in the laser printer body 1.

In the printer body 1, all the elements are driven by means of the main motor 307. A drive shaft 20*a* of the photoreceptor 20 and a drive shaft 23*a* of the developing unit 23 are connected individually to the eleotrophotographic process unit 3.

Figure 5:
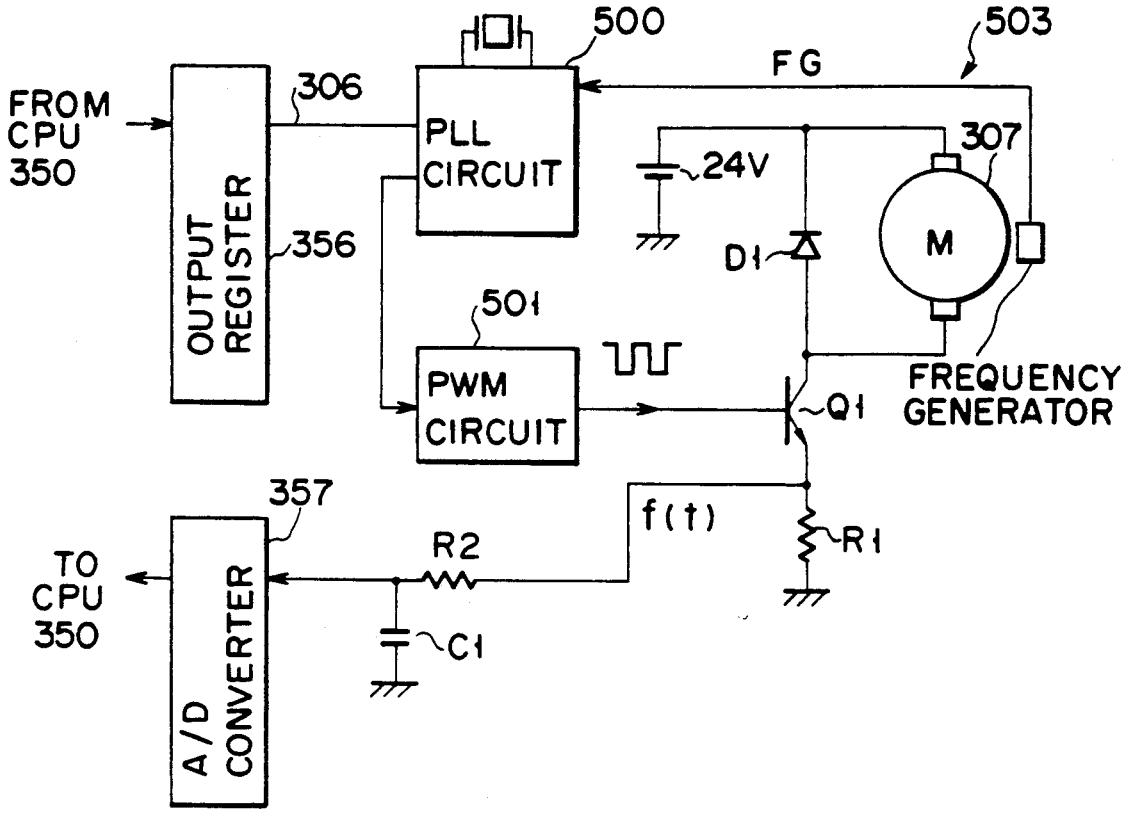
Fig. 5 is a circuit diagram showing a drive section for a main motor of the laser printer of FIG. 1.

FIG. 5 shows a drive section of the mechanism controller 306 in FIG. 2A for the main motor 307.

A PLL circuit 500 is turned or or off in response to the control signal from the output register 356. On receiving an on-signal from the register 356, the circuit 500 compares an FG 503 as a speed detection signal, generated in synchronism with the rotation cycle of the main motor 307, and a reference pulse generated in the PLL circuit 500. The resulting phase difference is delivered to a PWM circuit 501.

The PWM circuit 501 modulates the phase difference from the PLL circuit 500 into a pulse width, and supplies it as a drive signal to a transistor Q1. As the transistor Q1 is driven in this manner, the main motor 307 is rotated at constant speed in synchronism with the reference pulse in the PLL circuit 500.

A diode D1 is a commutating diode which operates when the transistor Q1 is off. A resistor R1 is a detection resistor for the motor current. The motor current is detected as a ½ voltage by the resistor R1. This detected voltage is applied to the A/D converter 357 through a filter which is composed of a resistor R2 and a capacitor C1.

Figure 6:
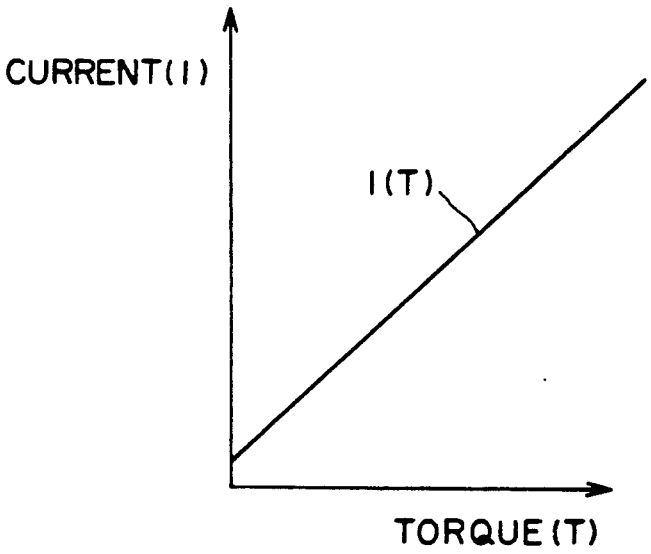
FIG. 6 is a graph showing the relationship between current and torque of a brush motor.

If the main motor 307 is a brush motor, it has a current-torque characteristic curve I(T), as shown in FIG. 6. Thus, the value in the A/D converter 357 is a detected value of the torque of the motor 307 (load on the motor 307).

Figure 7:
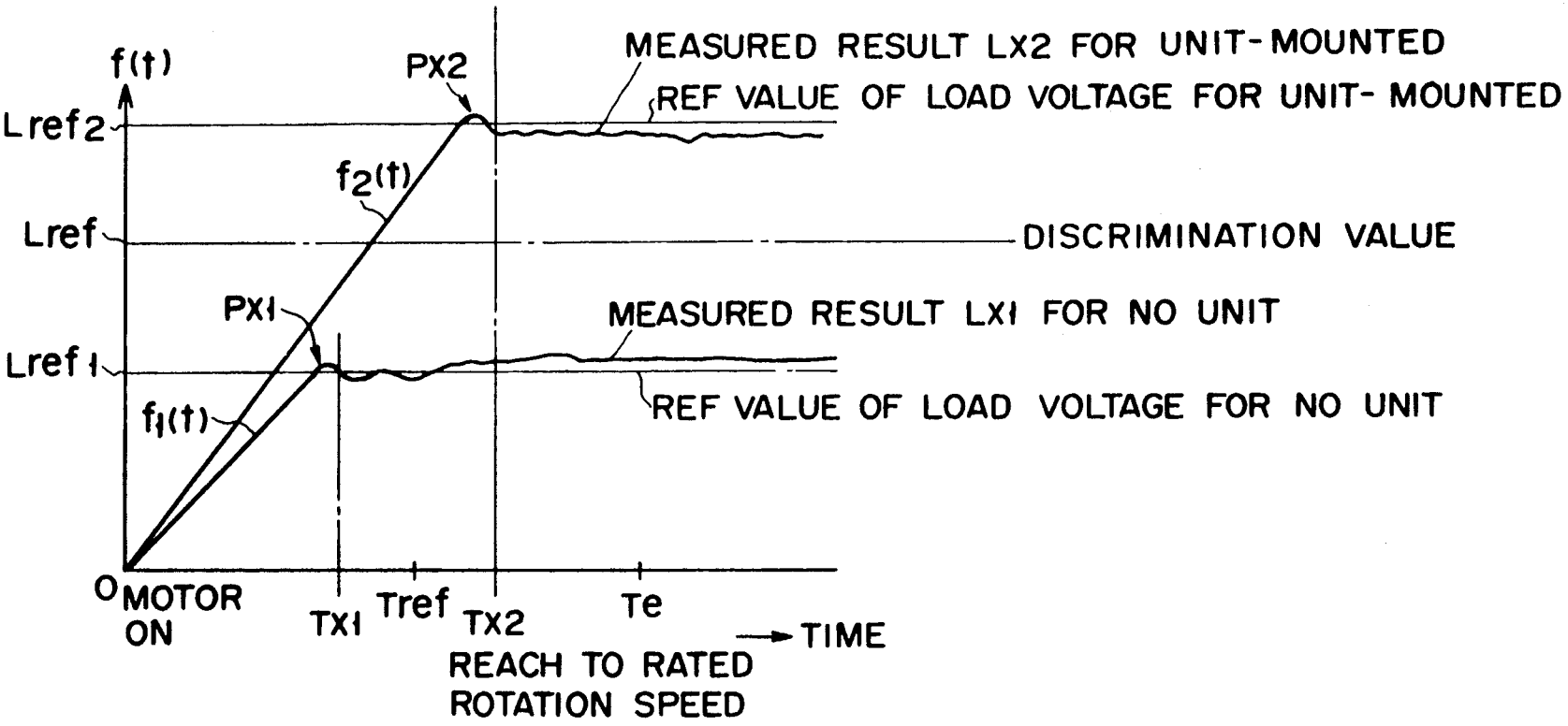
FIG. 7 illustrates a diagram explaining the state of a load, which varies depending on whether or not a unit of the printer is mounted.

Usually, the load torque of the motor 307 considerably varies depending on whether the electrophotographic process unit 3 is mounted or not. Therefore, the output (function f(t)) of the A/D converter 357, which corresponds to a load voltage (or load current) applied to the motor 307, changes depending on the state of the unit 3, as shown in FIG. 7. Detachment detection for the process unit 3 is effected utilizing these circumstances.

Figure 8:
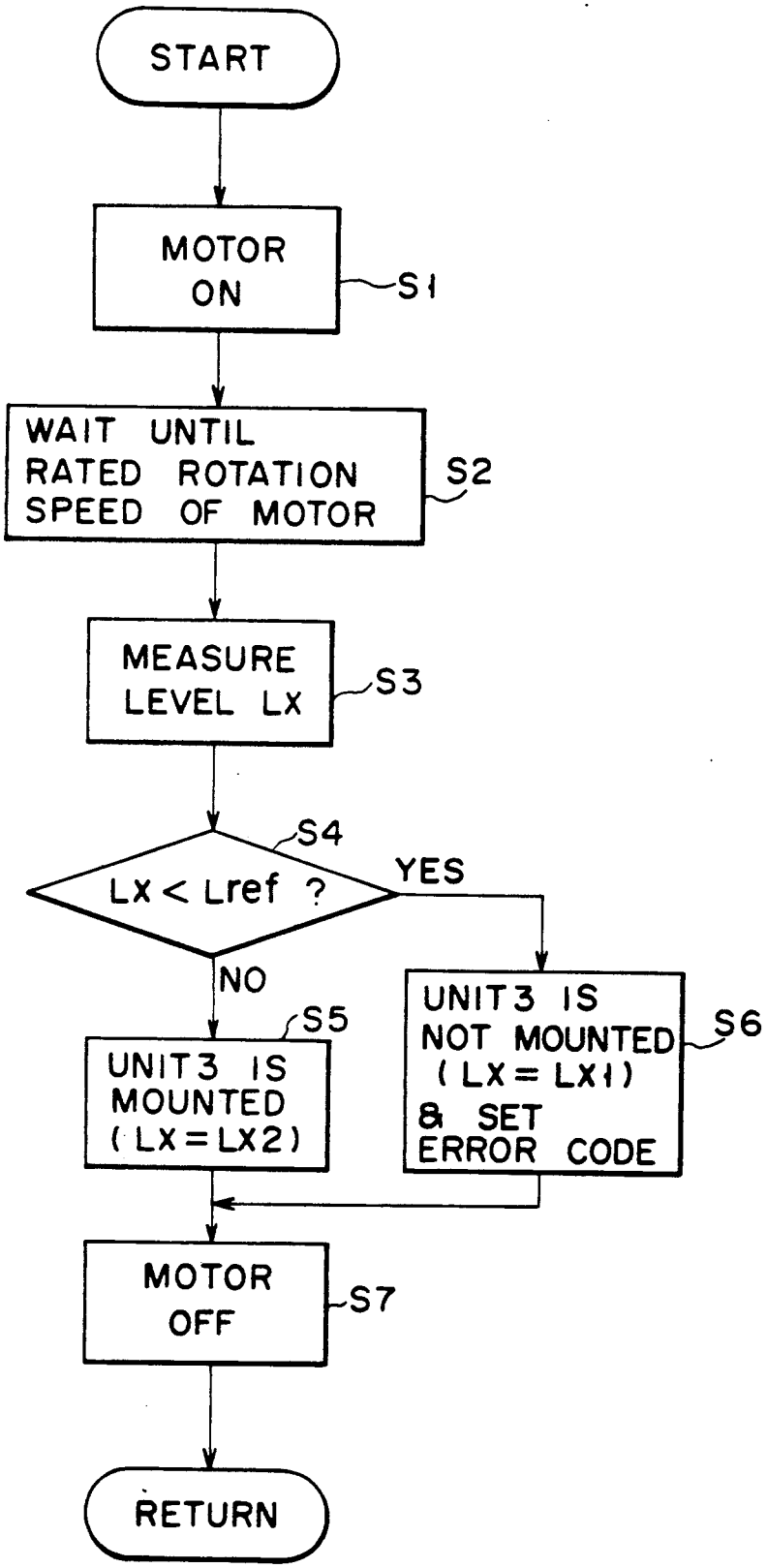
FIG. 8 is a flow chart illustrating an example of detachment detecting operation for the unit.

Referring now to the flow chart of FIG. 8, the detachment detection for the electrophotographic process unit 3, executed by the CPU 350 of FIG. 3, will be described.

First, the main motor 307 is turned on (Step S1). Attainment of a rated rotation speed by the rotation of the motor 307 is awaited for a given time (Te of FIG. 7) (Step S2). When the rated speed is attained, the value Lx of the output f(t) of the A/D converter 357 is read (Step S3). In a first measurement, the value is liable to be inaccurate due to a torque ripple or the like, so that ten measurements are made for each 0.1 second, for example, and the average of the resulting values is calculated ($Lx=\Sigma Lx/10$). The average load voltage Lx is compared with a reference value Lref previously stored in the $E^2$PROM 353 (Step S4).

In this case, the reference value Lref may be programmatically fixed. Alternatively, however, it may be obtained from the average value of, e.g., ten measurements of the motor current for each 0.1 second ($Lref=\Sigma Lref/10$), in order to absorb the variation of the load on the apparatus. In this case, the main motor 307 is driven without the electrophotographic process unit 3.

In the present embodiment, the reference value Lref is changed depending on the calculated average value. As shown in FIG. 7, for example, a value intermediate between a load voltage reference value Lref1 for a measured value Lx1 (load voltage), obtained with the unit 3 mounted, and a load voltage reference value Lref2 for a measured value Lx2, obtained with the unit 3 not mounted, is used as the reference value Lref for the discrimination of the unit attachment or detachment.

If the comparison indicates that the load voltage value as the measured value Lx2 is greater than the reference value Lref ($Lx>Lref$), it is concluded that the electrophotographic process unit 3 is mounted in place (Step S4; NO).

If the load voltage value Lx1 is smaller than the reference value Lref ($Lx<Lref$), on the other hand, it is concluded that the process unit 3 is not mounted (Step S4; YES), and an error code is set (Step S6).

Thereafter, the motor 307 is turned off, whereupon the processing is finished (Step S7).

The detachment detection is not limited to the electrophotographic process unit 3, and may be also applied to the laser exposure unit, the fixing unit, and the exit roller unit, for example.

If the reference value Lref is one in number, the attachment of only one unit can be discriminated. If a plurality of reference values Lref are used, the attachment of a plurality of units can be discriminated by comparing the measured values Lx for the individual values Lref.

As described above, the detachment detection for the units is effected utilizing the variation in load torque. More specifically, the detachment of the units is detected by measuring the change of load caused by the unit mounting. Accordingly, the detachment of a plurality of units can be achieved by means of one sensor. It is unnecessary, therefore, to provide a sensor for each individual unit, so that the number of components, and hence, the manufacturing costs, can be reduced, and also, the number of manufacturing processes can be reduced.

Figure 9:
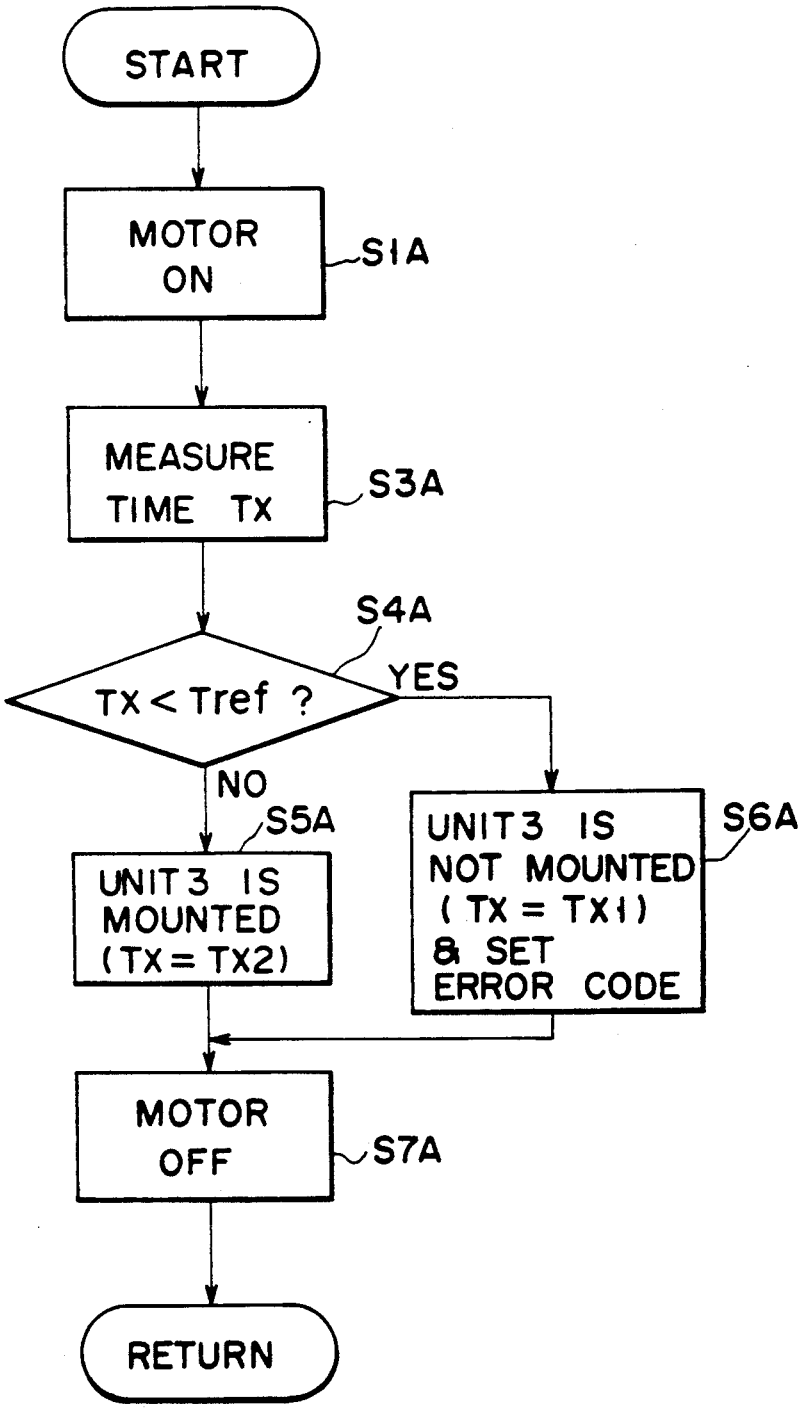
FIG. 9 is a flow chart illustrating another example of a detachment detecting operation for the unit.

The attachment or detachment discrimination for the unit 3 using a reference time value Tref can be effected in the manner shown in FIG. 9, for example.

After the motor is switched on (Step S1A), a timer counter (not shown) is started, and the value of the function f(t) (the output of the A/D converter 357 is measured for each 0.1 second, for example). The CPU 350 of FIG. 7 checks the change of the function value for each 0.1 second. When the CPU 350 concludes that the change of the function value covers 4 to 8 samples, for example, and is within the range of several digits, whether positive or negative, it stores the count value of the timer counter as a current measured time value Tx of the function f(t) (Step S3A).

Then, the CPU 350 compares the stored measured time value Tx and the predetermined reference time value Tref. If the measured value Tx is greater than the reference value Tref (Step S4A; NC), it is concluded that the unit 3 is mounted (Step S5A). If the measured value Tx is smaller than the reference value Tref (Step S4A; YES), it is concluded that the unit 3 is not mounted (Step S6A). When the attachment or detachment discrimination for the unit is finished in this manner, the motor 307 is cut off from the power supply (Step S7A).

In the embodiment described above, the measured value Lx of the function f(t), indicative of the time-based change of the load voltage, is obtained after the passage of the given time (Te) after the motor is switched on. Alternatively, however, the value Lx may be obtained as a measured value of the function f(t) immediately after the differential time value of the function f(t) becomes zero (f(t) is constant with respect to time) or when the secondary differential value of the function f(t) becomes zero (peak point of f(t)).

The differential value of the function f(t) can be obtained by sampling the function value for each 0.1 second (sampling period $Ts=0.1$ second), for example, and calculating the difference between the respective sampling values of the function f(t) and a function $f(t+Ts)$.

In the example described above, the attachment or detachment of the unit 3 is discriminated by the level measured value Lx. Alternatively, however, it may be discriminated by comparing the value for the time immediately after the differential time value of the function f(t) becomes zero (Tx1, Tx2 of FIG. 7) or when the secondary differential value of the function f(t becomes zero (Px1, Px2 of FIG. 7) with the reference value Tref.

Although the detachment detection for the electrophotographic process unit 3 has been mainly described in connection with the above embodiment, the present invention may also, be applied to various units whose attachment or detachment can change the motor load.

Although the reference value is stored in the $E^2$-PROM in the foregoing embodiment, moreover, any other nonvolatile memories may naturally be used for this purpose.

It is to be understood that various changes and modifications may be effected in the present invention by one skilled in the art without departing from the scope or spirit of the invention.

According to the present invention, as described in detail herein, there may be provided an image forming apparatus capable of checking a plurality of mounted units by means of a single sensor, thus permitting reduction in cost and in the number of assembling processes.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus having one or more units, comprising:

means for activating at least one of the units by electric power;

means for detecting a change in a value of the electric power to provide a detection result, said electric power depending on the number of units which are activated by said activating means; and means for comparing a characteristic value representing said detection result with a predetermined reference value to provide a comparison result, and detecting from said comparison result whether or not any units are activated by said activating means;

wherein said comparing means includes:

means for sensing a firs stationary value of said characteristic value when said unit is not activated by said activating means, and sensing a second stationary value of said characteristic value when said unit is activated by said activating means; and means for generating said predetermined reference value from said first and second stationary values, such that said predetermined reference value falls between said first and second stationary values.

2. An apparatus according to claim 1, wherein said comparing means further includes:

means for detecting a rate of change of said detection result to provide either of said first and second stationary values.

3. An image forming apparatus having one or more units, comprising:

means for activating at least one of the units by electric power;

means for detecting a change in a value of the electric power to provide a detection result, said electric power depending on the number of units which are activated by said activating means; and means for comparing a characteristic value representing said detection result with a predetermined reference value to provide a comparison result, and detecting from said comparison result whether or not any units are activated by said activating means;

wherein said comparing means includes:

means for sensing a first timing value of said characteristic value measured with respect to a predetermined time point when said unit is not activated by said activating means, and sensing a second timing value of said characteristic value measured with respect to the predetermined time point when said unit is activated by said activating means; and means for generating said predetermined reference value from said first and second timing values, such that said predetermined reference value falls between said first and second timing values.

4. An apparatus according to claim 3, wherein said comparing means further includes:

means for detecting a rate of change of said detection result to provide either of said first and second timing values.

5. An image forming apparatus having one or more units, comprising:

a motor for activating at least one of the units by means of a current flowing through the motor;

means for detecting a change in value of the current to provide a detection result, said current corresponding to the number of units activated by said motor; and means for comparing a characteristic value representing said detection result with a predetermined reference value to provide a comparison result as to whether or not at least one of said units is activated by said motor.

6. An apparatus according to claim 5, wherein said comparing means includes:

means for sensing a first stationary value of said characteristic value when the unit is not activated by said motor, and sensing a second stationary value of said characteristic value when the unit activated by said motor; and means for generating said predetermined reference value from said first and second stationary values, such that said predetermined reference value falls between said first and second stationary values.

7. An apparatus according to claim 6, wherein said comparing means further includes:

means for detecting a rate of change of said detection result to provide either of said first and second stationary values.

8. An apparatus according to claim 5, wherein said comparing means includes:

means for sensing a first timing value of said characteristic value measured with respect to a predetermined point in time when the unit is not activated by said motor, and sensing a second timing value of said characteristic value measured with respect to the predetermined point in time when the unit is activated by said motor; and means for generating said predetermined reference value from said first and second timing values, such that said predetermined reference value falls between said first and second timing values.

9. An apparatus according to claim 8, wherein said comparing means further includes:

means for detecting a rate of change of said detection result to provide either of said first and second timing values.

* * * * *